US007509995B2

(12) United States Patent
Bhatti et al.

(10) Patent No.: US 7,509,995 B2
(45) Date of Patent: Mar. 31, 2009

(54) HEAT DISSIPATION ELEMENT FOR COOLING ELECTRONIC DEVICES

(75) Inventors: Mohinder Singh Bhatti, Amherst, NY (US); Ilya Reyzin, Williamsville, NY (US); Debashis Ghosh, Amherst, NY (US); Shrikant Mukund Joshi, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 600 days.

(21) Appl. No.: 10/840,410

(22) Filed: May 6, 2004

(65) Prior Publication Data

US 2005/0247432 A1 Nov. 10, 2005

(51) Int. Cl.
*F28F 7/00* (2006.01)
*H05K 7/20* (2006.01)

(52) U.S. Cl. ..... 165/80.3; 165/80.4

(58) Field of Classification Search ..... 165/185, 165/80.3, 80.4, 104.33, 104.34; 361/697–699, 361/702–704; 174/16.3
See application file for complete search history.

(56) References Cited

U.S. PATENT DOCUMENTS 3,481,393 A * 12/1969 Chu ..... 165/80.4
5,003,429 A * 3/1991 Baker et al. ..... 361/704
5,777,259 A * 7/1998 Mennucci et al. ..... 174/16.3
6,050,332 A * 4/2000 Smith et al. ..... 165/185
6,109,345 A * 8/2000 Giacomel ..... 165/185
6,310,771 B1 * 10/2001 Chien ..... 361/697
6,588,498 B1 7/2003 Reyzin et al. ..... 165/104.33
6,735,864 B2 * 5/2004 Sato et al. ..... 29/890.03
6,771,508 B1 * 8/2004 Ghosh ..... 361/704
6,789,610 B1 * 9/2004 Hegde ..... 165/104.21
6,807,059 B1 * 10/2004 Dale ..... 361/703
6,867,973 B2 * 3/2005 Chang ..... 361/699
2005/0161806 A1 * 7/2005 Divakar et al. ..... 257/717

FOREIGN PATENT DOCUMENTS

EP 1253639 A2 10/2002
WO 02/092897 A1 11/2002

* cited by examiner

*Primary Examiner*—Tho v Duong
(74) *Attorney, Agent, or Firm*—Patrick M. Griffin

(57) ABSTRACT

A heat dissipation element for cooling an electronic device is disclosed. The heat dissipation element has a top surface and a bottom surface for mounting the electronic device to be cooled thereto. The top surface defines a heat dissipation area for dissipating heat from the electronic device and a plurality of heat transfer fins project upwardly from the top surface and are coextensive with the heat dissipation area. Each of the heat transfer fins defines a plurality of steps having a rise and a run and each of the steps extend across the heat dissipation area for maximizing an amount of heat dissipated from the electronic device. The heat dissipation element is particularly useful in either one of a cold plate assembly used with a liquid cooled unit (LCU) or a boiler plate assembly used with a thermosiphon cooling unit (TCU).

5 Claims, 4 Drawing Sheets

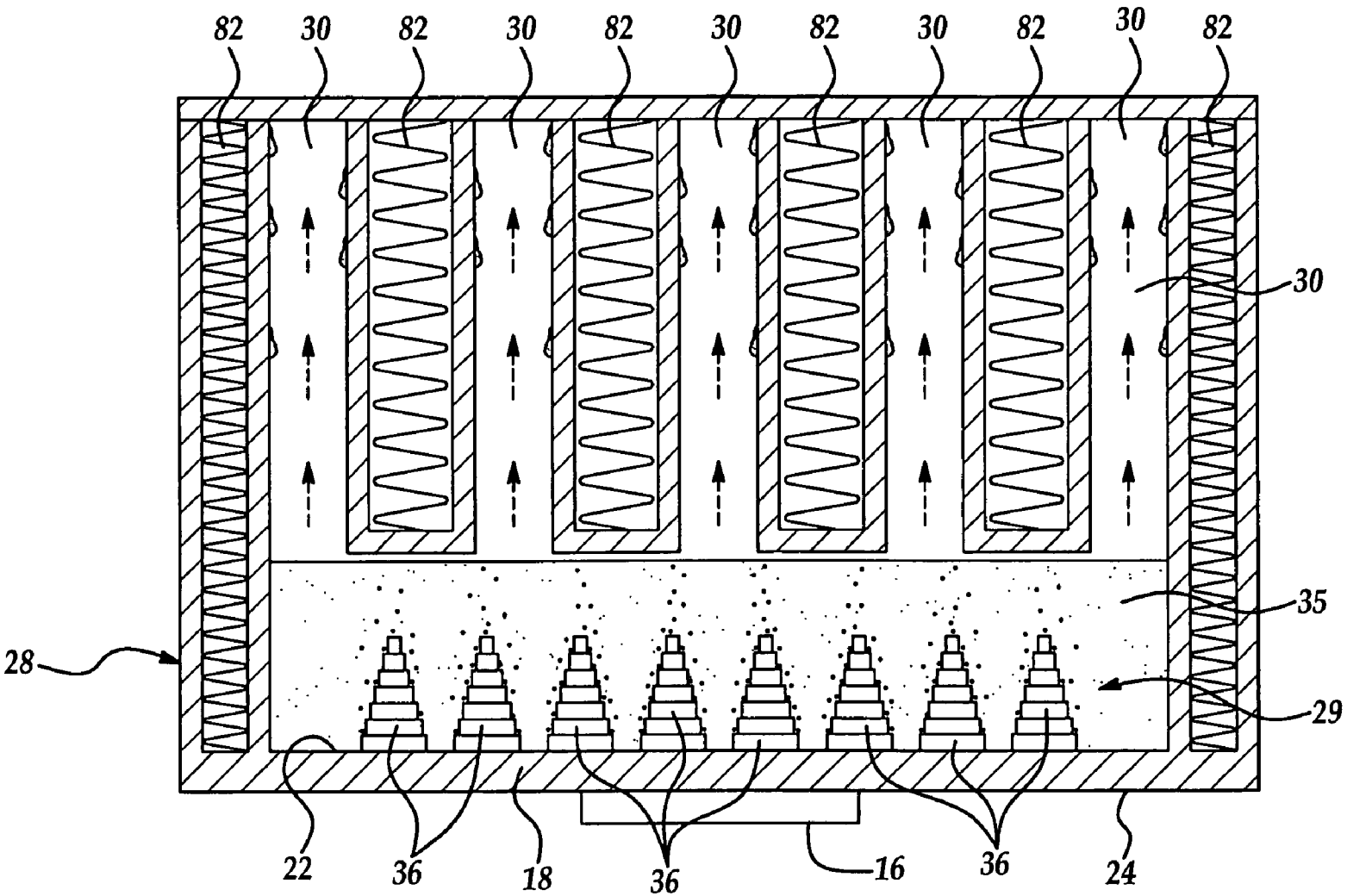
82
30
82
30
82
30

HEAT DISSIPATION ELEMENT FOR COOLING ELECTRONIC DEVICES

BACKGROUND OF THE INVENTION

1. Field of the Invention

The subject invention relates to a heat dissipation element for cooling an electronic device, and more specifically to a heat dissipation element capable of dissipating an increased amount of generated heat from an electronic device.

2. Description of Related Art

Research activities have focused on developing assemblies to efficiently dissipate heat from electronic devices that are highly concentrated heat sources, such as microprocessors and computer chips. These electronic devices typically have power densities in the range of about 5 to 35 W/cm$^2$ and relatively small available space for placement of fans, heat exchangers, heat sink assemblies and the like. However, these electronic devices are increasingly being miniaturized and designed to achieve increased computing speeds that generate heat up to 200 W/cm$^2$.

Heat exchangers and heat sink assemblies have been used that apply natural or forced convection cooling methods to cool the electronic devices. These heat exchangers typically use air to directly remove heat from the electronic devices. However, air has a relatively low heat capacity. Such heat sink assemblies are suitable for removing heat from relatively low power heat sources with power density in the range of 5 to 15 W/cm$^2$. The increased computing speeds result in corresponding increases in the power density of the electronic devices in the order of 20 to 35 W/cm$^2$ thus requiring more effective heat sink assemblies.

In response to the increased heat to be dissipated, liquid-cooled units called LCUs employing a cold plate in conjunction with high heat capacity fluids, like water and water-glycol solutions, have been used to remove heat from these types of high power density heat sources. One type of LCU circulates the cooling liquid so that the liquid removes heat from the heat source, like a computer chip, affixed to the cold plate, and is then transferred to a remote location where the heat is easily dissipated into a flowing air stream with the use of a liquid-to-air heat exchanger and an air moving device such as a fan or a blower. These types of LCUs are characterized as indirect cooling units since they remove heat from the heat source indirectly by a secondary working fluid, generally a single-phase liquid, which first removes heat from the heat source and then dissipates it into the air stream flowing through the remotely located liquid-to-air heat exchanger.

As computing speeds continue to increase even more dramatically, the corresponding power densities of the devices rise up to 200 W/cm$^2$. The constraints of the miniaturization coupled with high heat flux generated by such devices call for extremely efficient, compact, and reliable thermosiphon cooling units called TCUs. A typical TCU absorbs heat generated by the electronic device by vaporizing the captive working fluid on a boiler plate of the unit. The boiling of the working fluid constitutes a phase change from liquid-to-vapor state and as such the working fluid of the TCU is considered to be a two-phase fluid. The vapor generated during boiling of the working fluid is then transferred to an air-cooled condenser, in close proximity to the boiler plate, where it is liquefied by the process of film condensation over the condensing surface of the TCU. The heat is rejected into an air stream flowing over a finned external surface of the condenser. The condensed liquid is returned back to the boiler plate by gravity to continue the boiling-condensing cycle.

These TCUs require boiling and condensing processes to occur in close proximity to each other thereby imposing conflicting thermal conditions in a relatively small volume. This poses significant challenges to the process of optimizing the TCU performance.

Illustrative examples of the prior art are shown in U.S. Pat. Nos. 6,360,814 and 5,998,863. The '814 patent discloses a TCU having a boiler plate with rectangular shaped fins. The rectangular shaped fins dissipate heat from the electronic device. The '863 patent discloses another TCU having a boiler plate with fins for dissipating heat. The fins are transverse to the cooling fluid flow and therefore restrict the flow of the cooling fluid and divide the chamber into discrete compartments. Such a design reduces the amount of heat that the TCU is capable of dissipating. Another TCU is disclosed in WO 02/092897 having a boiler plate with various shaped fins. However, none of these references discloses a cooling unit having a plurality of fins attached to the cold plate or the boiler plate incorporating a plurality of steps aligned parallel to or normal to a working fluid flow to increase the heat dissipation rate.

Accordingly, it would be advantageous to provide a heat dissipation element having a plurality of fins defining a plurality of steps that extend across the heat dissipation area for maximizing heat dissipation. The plurality of fins, if too large, does not fully utilize the excess fin surface area for heat dissipation, while if too small, does not provide enough fin surface area for heat dissipation. Therefore, it would be advantageous to provide optimally sized fins to maximize the heat dissipation rate. The heat dissipation element would be particularly useful either for use in a LCU employing a single-phase liquid in conjunction with a cold plate or for a TCU employing a two-phase fluid in conjunction with a boiler plate.

BRIEF SUMMARY OF THE INVENTION

The subject invention provides a heat dissipation element for cooling an electronic device. The heat dissipation element includes a top surface and a bottom surface for mounting thereto an electronic device to be cooled. The top surface defines a heat dissipation area for dissipating heat from the electronic device. A plurality of heat transfer fins project upwardly from the top surface and is coextensive with the heat dissipation area to dissipate increased amounts of heat. Each of the heat transfer fins defines a plurality of steps having a rise and a run and each of the steps extend across the heat dissipation area for maximizing an amount of heat to be dissipated from the electronic device.

The subject invention overcomes the inadequacies of the related art cooling units. Specifically, the subject invention dissipates large amounts of heat in a compact space and at a reduced cost. The plurality of steps extending across the heat dissipation area maximizes the amount of heat dissipation by effectively utilizing the cooling potential of the working fluid flow. Further, the plurality of heat transfer fins has minimized mass, which improves the efficiency without increasing costs.

BRIEF DESCRIPTION OF THE SEVERAL VIEWS OF THE DRAWING

Other advantages of the present invention will be readily appreciated, as the same becomes better understood by reference to the following detailed description when considered in connection with the accompanying drawings wherein:

FIG. 7 is a cross-sectional view of the boiler plate assembly of the TCU along line 7-7 shown in FIG. 6.

DETAILED DESCRIPTION OF THE INVENTION

Figure 1:
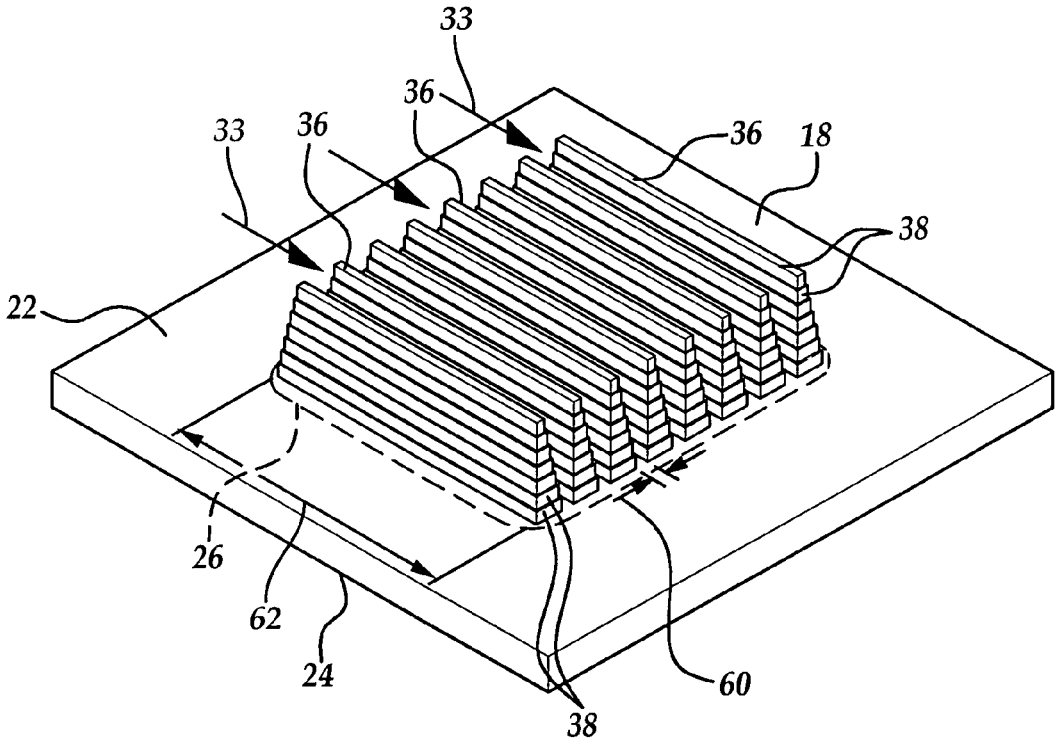
FIG. 1 is a perspective view of a top surface of a heat dissipation element having a plurality of heat transfer fins extending upwardly and defining a plurality of steps coextensive with a heat dissipation area.

Referring to the Figures, wherein like numerals indicate like or corresponding parts throughout the several views, a heat dissipation element for cooling an electronic device 16 is shown generally at 18 in FIG. 1. The subject invention is particularly useful with electronic devices 16 (best shown in FIGS. 5 and 7) such as, but not limited to, computer chips, telecommunication chips, microprocessor assemblies, and the like. These electronic devices 16 are used in various systems (not shown), such as computer systems, telecommunication systems, and the like. The electronic devices 16 are preferably flexibly attached to the heat dissipation element 18. However, one skilled in the art may connect the electronic devices 16 by other methods without deviating from the subject invention.

The heat dissipation element 18 includes a top surface 22 and a bottom surface 24 for mounting thereto the electronic device 16 (FIGS. 4, 5, and 7) to be cooled. The top surface 22 defines a heat dissipation area 26 for dissipating heat from the electronic device 16. The heat dissipation element 18 may be formed of any metal, but is preferably formed of aluminum or copper.

Figure 5:
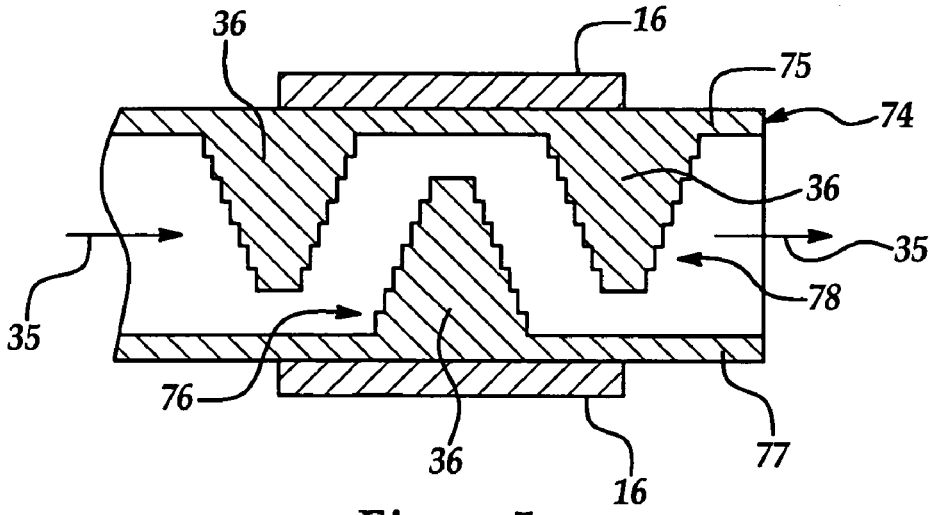
FIG. 5 is a cross-sectional view of the cold plate assembly of the LCU shown in FIG. 4 having the heat dissipation element with the fins aligned normal to the working fluid flow.
Figure 4:
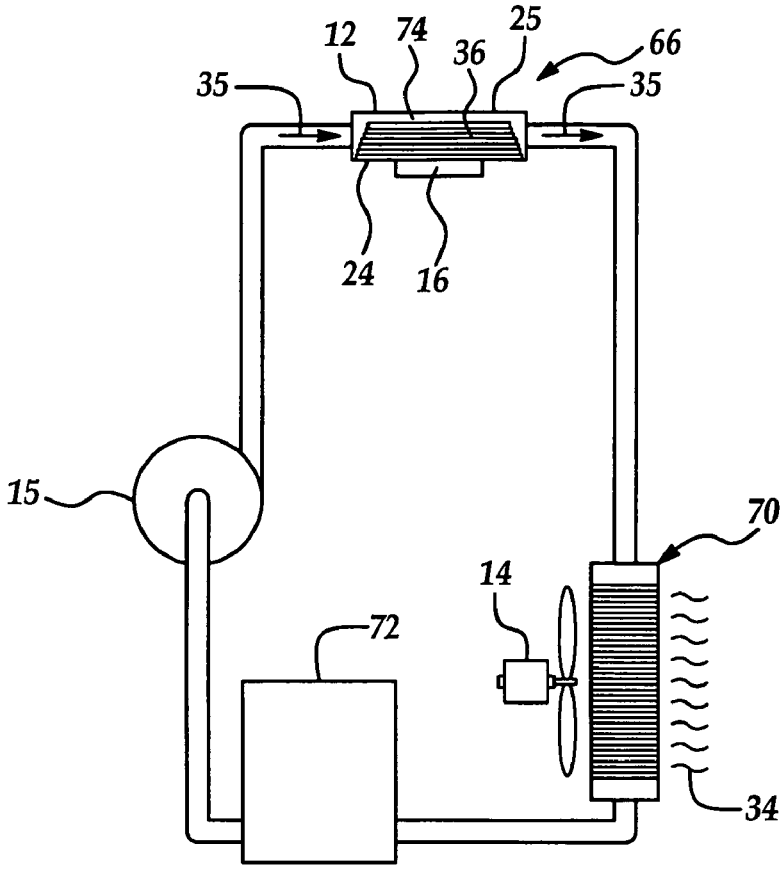
FIG. 4 is a schematic view of a LCU with a cold plate incorporating the heat dissipation element of the subject invention aligned parallel to the working fluid flow.
Figure 6:
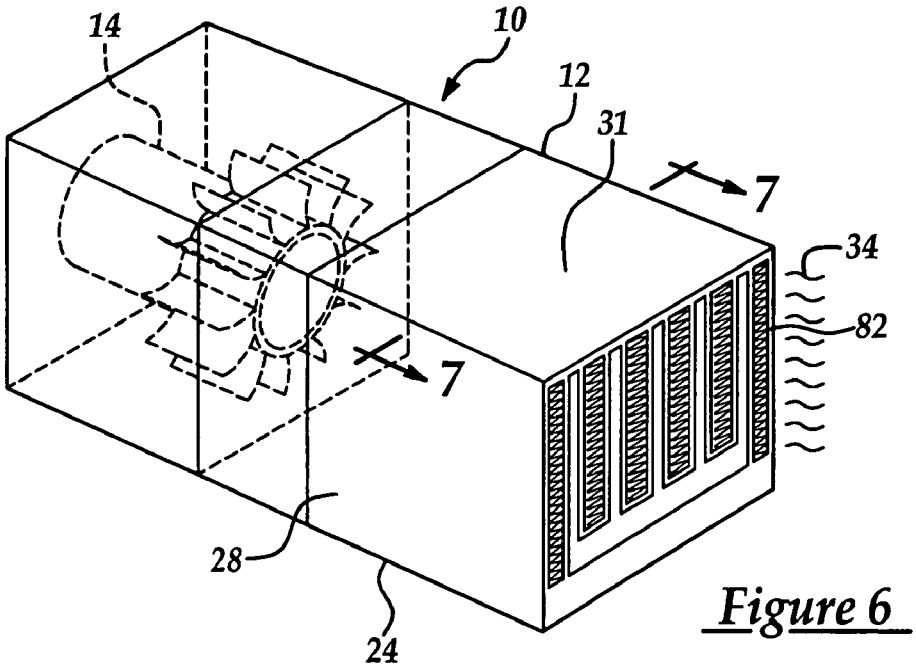
FIG. 6 is a perspective view of a TCU with a boiler plate incorporating the heat dissipation element of the subject invention.

The heat dissipation element 18 is affixed to the cold plate assembly 74 of the LCU 66 shown in FIGS. 4 and 5 and to the boiler plate assembly 28 of the TCU 10 shown in FIGS. 6 and 7. It may be noted that when integrated with the LCU 66 the heat dissipation element 18 becomes synonymous with the cold plate assembly 74 and when integrated with the TCU 10 it becomes synonymous with the boiler plate assembly 28.

The operation of the LCU 66 with the cold plate assembly 74 incorporating the heat dissipation element 18 is described below in detail with reference to FIG. 4. The LCU 66 comprises the electronic device 16 generating an amount of heat to be dissipated, a working fluid moving device 15, the working fluid storage tank 72 to store excess working fluid, a cooling fluid moving device 14 operating in conjunction with a heat exchanger 70 to dissipate heat from the working fluid 35 to the cooling fluid 34.

The working fluid 35 is propelled through the LCU 66 by the fluid moving device 15. One example of the working fluid moving device 15, but not limited to, is a pump. The pump may be any type capable of supplying the working fluid 35 at a rate sufficient to dissipate the required amount of heat.

The cooling fluid 34 is propelled through the heat exchanger 70 of the LCU 66 by the cooling fluid moving device 14. One example of the cooling fluid moving device 14, but not limited to, is an axial fan. The fan can be any type, a pull or push type, capable of supplying the cooling fluid 34 to the heat exchanger 70 at a rate sufficient to dissipate the required amount of heat from the heat-generating element 16.

The LCU 66 includes a cold plate 74 inside the enclosure 13 having at least one heat dissipation element 18 therein. The heat dissipation element 18 may be formed integrally with the cold plate 74 or mounted thereto. The electronic device 16 generates a large amount of heat and the heat is transferred from the electronic device 16 to the bottom surface 24 of the heat dissipation element 18. The heat is then conducted from the bottom surface 24 to the fins 36 and thence to the working fluid 35 for dissipation into the cooling fluid 34.

The cold plate enclosure 13 has an upper surface 25 and a lower surface 24. The electronic device 16 is mounted to the lower surface 24 in FIG. 4. It is possible to mount multiple electronic devices 16 on a cold plate enclosure 13. For example, in FIG. 5, a first heat dissipation element 76 extends upwardly from the lower surface 77 and a second heat dissipation element 78 extends downwardly from the upper surface 75.

In all embodiments of the LCU 66, the working fluid 35 passes over the fins 36 to absorb the heat generated by the electronics device as explained above. As best shown in FIG. 5, when the first and the second heat dissipation element 76, 78 are used, flow channels are created between the adjacent steps 38 within the fins 36. The working fluid 35 flows along the surfaces of the steps 38 and dissipates heat thereto. When only the first heat dissipation element 76 is used, the working fluid 35 must still flow along each of the steps 38, but the flow channel is not as tortuous and therefore less effective in removing heat from the fins 36.

The plurality of heat transfer fins 36 could be aligned parallel to or normal to the direction of a flow of the working fluid 35 moving through the LCU 66 propelled by the fluid moving device 15. The inner corner regions 46 are the areas of the highest heat transfer and when the working fluid 35 passes along the corner regions, a maximum amount of heat is transferred. The LCU 66 generally uses a single-phase working liquid 35, like water and water glycol solution, which do not undergo phase change, i.e., remain in liquid state throughout the system.

When the fluid moving device 15 operates at a slower speed, the working fluid 35 moves at a laminar flow rate. When the fluid moving device 15 operates at a faster speed, the working fluid 35 moves at a turbulent flow rate. With laminar flow the optimum fin height 58 and optimum fin base width 50 are larger than the corresponding values in turbulent flow. The dimensional details of the cold plate assembly 74 will be presented later after detailed description of the heat dissipation element 18.

Referring now to the boiler plate assembly 28 of the TCU 10 in FIGS. 6 and 7, the electronic device 16 is positioned on the bottom surface 24 of the boiler plate assembly 28 such that the electronic device 16 is adjacent the heat dissipation fins 36 on the top surface 22. The electronic device 16 generates a large amount of heat, which is transferred from the electronic device 16 to the bottom surface 24 of the boiler plate assembly 28. The heat is then conducted from the bottom surface 24 to the top surface 22 where it is absorbed by the fins 36 and thence transferred to the working fluid 35 by the process of boiling for eventual dissipation into the cooling fluid 34.

The TCU 10 includes the housing 12, the cooling fluid moving device 14 placed within the housing 12 for creating a flow of a cooling fluid 34, such as air, through a chamber 31 within the housing 12, the electronic device 16 affixed to the base 24 of the chamber 31, and a boiler plate assembly 28 comprising the boiling chamber 29 and the condenser tubes 30 mounted directly above the boiler plate assembly 28.

Referring now to the cross-sectional view of the chamber 31 in FIG. 7, a plurality of heat transfer fins 36 projects upwardly from the top surface 22. A two-phase working fluid 35 in a state of liquid is in contact with the plurality of heat transfer fins 36. Once the heat generated by the electronic device 16 is conducted to the top surface 22, the heat transfer fins 36 absorb it and then transfer it to the working fluid 35 by the process of boiling.

The boiler plate assembly 28 in a TCU comprises a boiling chamber 29 in direct fluid communication with the condensing chamber comprising a plurality of tubes 30 to condense working fluid 35 vapor indicated by the upward pointing arrows in FIG. 7. The working fluid 35 exists in liquid form at the bottom of the boiling chamber 29 and in vapor form at the top of the boiling chamber 29.

The working fluid 35 is charged into the boiler plate assembly 28 in a captive fashion such that it does not come into direct contact with the cooling fluid stream 34 flowing through the convoluted fins 82. The working fluid 35 is preferably a two-phase fluid that undergoes phase transformation from liquid-to-vapor in the boiling chamber 29 and the reverse transformation from vapor-to-liquid in the condenser tubes 30. The plurality of heat transfer fins 36 is partially or totally submerged in the working fluid 35 in the boiling chamber 29. As the heat is transferred to the fins, the corner regions 44, 46 of the fin 36 serve as nucleation sites, where the working fluid 35 boils or evaporates.

The vapor of the working fluid 35, indicated by the upward pointing arrows, is generated at the surface of the fin array 36 in the boiling chamber 29 and it ascends into the condenser tubes 30 by virtue of its lower density compared to the density of the working fluid 35 in liquid form. Likewise the condensed liquid on the walls of the condenser tubes 30 descends to the boiling chamber 29 by reason of its greater density compared to the density of the ascending vapor. It is thus apparent that the movement of the working fluid between the boiling chamber 29 and the condenser tubes 30 is governed by the fluid density and vapor pressure differences without the need of a fluid moving device like a pump 15 in the LCU 66 shown in FIG. 4.

The convoluted fins 82, mounted between the condenser tubes 30, absorb heat removed from the working fluid vapor 35 within the condenser tubes 30 and dissipate it into the cooling fluid stream 34 propelled by the fluid moving device 14. The fluid moving device 14, shown in FIG. 6, is used to force a cooling gas 34, such as air, through the condenser tubes to promote the condensation of the working fluid vapor 35 inside the condenser tubes 30. The cooling fluid moving device 14 may be, but not limited to, a single or a dual axial fan. The fan could be a pull or push type fan; however, a pull type of fan is preferred to minimize shadowing effect of the fan hub on cooling gas flow. After removing heat from the condenser vapor in the condensing tubes 30 the cooling gas 34 is vented from the TCU housing 12 through the convoluted fins 82 as shown in FIG. 6.

Figure 2:
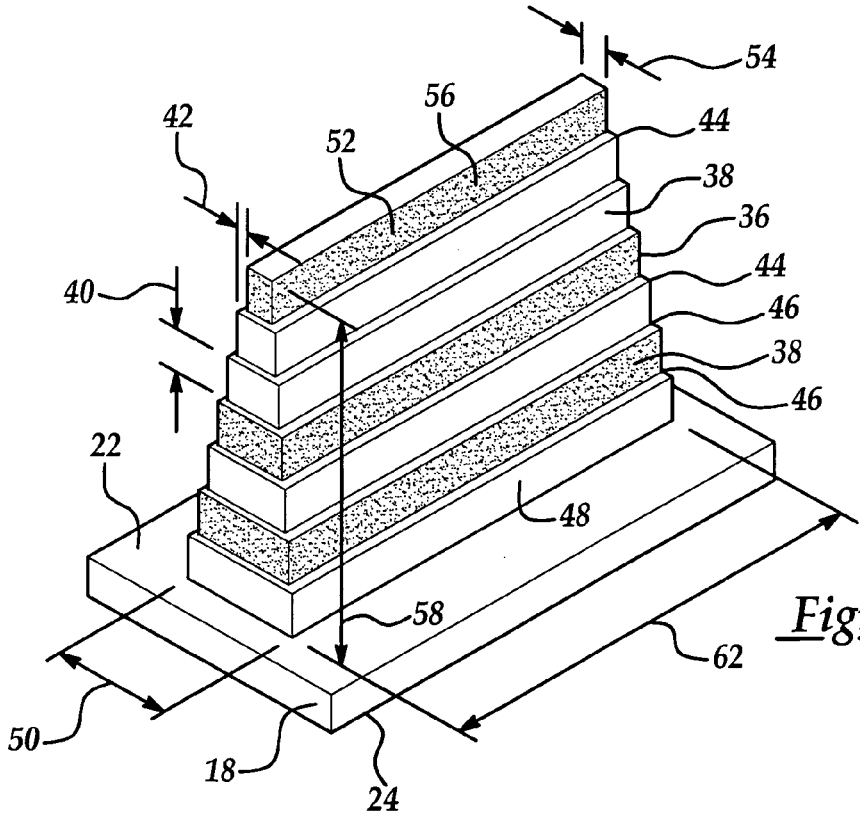
FIG. 2 is an enlarged perspective of one of the plurality of heat transfer fins.

Referring now to FIG. 2 for more details of the heat dissipation element 18, synonymous with cold plate assembly 74 and the boiler plate assembly 28, each of the heat transfer fins 36 defines a plurality of steps 38 having a rise 40 and a run 42, and each of the steps 38 extends across the heat dissipation area 26 for maximizing an amount of heat dissipated from the electronic device 16. Each of the plurality of steps 38 has a rise to run ratio in the range of 1 to 4. The intersection of the rise 40 and the run 42 define outer corner regions 44 and the junction of the next adjacent steps 38 defines inner corner regions 46. Corner regions are regions of heat concentration and as a result serve as enhanced heat dissipation sites to promote the transfer of heat to a working fluid 35. In order to achieve maximum dissipation of heat from the electronics device 16, each of the plurality of steps 38 must provide a sufficient surface area in contact with the working fluid 35 depending upon the particular application as described below. Therefore, the steps 38 include a base step 48 having a first width (base width) 50 and a top step 52 having a second width (tip width) 54.

The steps 38 having a tip-to-base width ratio in the range of 0 to 1 achieve the maximum heat dissipation. The ratio 0 corresponds to an isosceles triangular profile fin with a sharp knife-edge fin tip and the ratio 1 corresponds to a rectangular profile fin with flat fin tip. For the maximum heat dissipation it is preferred to taper the fin 36 upwardly to maintain uniform heat flux through the fin height 58. Therefore, the upper limit of the tip-to-base width ratio is restricted to 0.95. Between the limiting values of 0 and 0.95, the fins 36 of the subject invention can have any value of the tip-to-base width ratio suitable for a given application.

Once the base width 50 is selected and the desired tip-to-base width ratio is known, then the optimal tip width 54 can be determined. The base width 50 is selected based upon the application, as well as the material that forms the heat dissipation element 18.

The rise 40 of each of the plurality of steps 38 preferably has a rough texture 56. Sandblasting or electrochemical etching forms the rough texture 56. There are various other methods for creating the rough texture 56 known to those skilled in the art. Additionally, other surfaces, such as the run 42 of the steps 38 and the top surface 22 of the heat dissipation element 18, which are exposed to the working fluid 35, may be sandblasted, electrochemically etched, or treated in an alternate manner to form the rough texture 56. The roughness of the surfaces enhances the heat transfer from the fins 36.

To further improve the efficiency of the heat dissipation element 18, each of the heat transfer fins 36 has an optimal fin height 58. The fin height 58 is measured from the heat dissipation area 26 to the top step 52. Preferably, the fin height 58 is from 4 millimeters to 15 millimeters. The fin height is modified based upon the particular application.

To further improve the efficiency of the heat dissipation element 18, each of the heat transfer fins 36 has an optimal base width 50. Preferably, the base width 50 is from 0.2 millimeter to 3 millimeters. The base width is modified based upon the particular application.

Additionally, the plurality of the heat transfer fins 36 should be spaced apart from one another by a predetermined fin gap 60 (FIG. 1). The plurality of the heat transfer fins 36 also have a length 62 (FIG. 2) of at most fifty times the predetermined fin gap 60, which ensures maximum heat dissipation by ensuring that the thermal boundary layers growing from the opposing fin walls in a LCU do not bridge the fin gap 60 between two adjoining fins 36. The growth of the thermal boundary layers is promoted by the forced flow of the working fluid 35 through the fin gaps 60. Since there is no forced flow of the working fluid 35 through the fin gaps 60 in a TCU, the aforementioned relation between the fin gaps 60 and the fin length 62 does not apply to a TCU.

The fin width, height, and length are important to optimize the transmission of heat through the heat dissipation element 18 and fins 36 and into working fluid 35. If the fins are too small or too large, optimal heat transfer may not be achieved. With too small fins the heat dissipation area is too small and with too large fins the top portion of the fin does not participate in heat dissipation.

It has further been determined that to maximize the heat transfer while minimizing the fin material cost, the mass of the heat transfer fins 36 should be judiciously reduced. Those skilled in the art have determined that the minimum mass of a fin can be achieved by having arcuate sides 64. However, the preferred magnitude of the radius, R, to generate such an arcuate side for a given fin material and working fluid has not been established. According to the teachings of the subject invention, the preferred radius R can be determined using the relation $$R = \frac{1}{2}\left(\frac{k}{h}\right)$$

where k is the thermal conductivity of the fin material and h is the heat transfer coefficient of the working fluid.

To prepare the heat dissipation element 18 having the fin with arcuate sides 64, the fin is initially manufactured only with the arcuate sides 64. The plurality of steps 38 would later be machined into the arcuate sides 64 providing for increased heat transfer because of the corner regions being present along with the minimal mass. However, it may be possible to extrude the heat dissipation element 18 having the plurality of steps 38 already present in the arcuate sides 64.

In the optimally designed heat transfer fins 36, the fin tip temperature approaches the temperature of the working fluid 35. In the subject invention, the temperature of the corner regions 44 and 46 of the straight or the arcuate sides 64, with reduced mass due to the plurality of steps 38, is also made to approach the temperature of the working fluid 35 thereby enhancing the heat dissipation rate. If the fins 36 have too much mass or are too large, all fin mass does not participate in heat dissipation. Likewise, if the fins 36 are too small or too short, the heat dissipation is restricted due to mass limitation.

Preferably, in all embodiments, the heat dissipation element 18 and the plurality of heat transfer fins 36 are formed from a continuous, homogenous material. One method of forming the continuous, homogenous material is by using an extrusion process. If the heat dissipation element 18 and the heat transfer fins 36 are formed from the homogenous material, then the rate at which the heat is transferred from the electronic device 16 is uniform and consistent. Further, forming the heat dissipation element 18 and the heat transfer fins 36 by the extrusion process reduces the cost of manufacturing the heat dissipation element 18 versus forging and metal stamping.

Typical working fluids 35 employed with the subject invention include, but are not limited to, demineralized water, methanol, halocarbon fluids, and the like. One example of a possible halocarbon fluid is R134a. It is to be understood that one skilled in the art may select various working fluids 35 depending upon the amount of heat generated by the specific electronic component and the operating temperature of the electronic device 16. However, it is preferable that the working fluid 35 is a liquid rather than a gas.

Presented in Tables 1 are the optimal values of the fin height 58 and the fin base width 50 for a cold plate assembly 74. The fin is designed to dissipate 15 W of heat per unit time with a temperature difference of 15° C. between the fin tip and the fin base. The fin length 62 is 50 millimeters. The tabular results correspond to two fin materials, aluminum and copper and two working fluid flow rates—laminar and turbulent.

TABLE 1

Optimal Fin Height 58 and Fin Base Width 50 for a Cold Plate Assembly 74 with Fin Tip-to-Base Ratio of 0.5

| Fin Material | Working fluid Flow | Fin Height 58, mm | Fin Base Width 50, mm | Ratio of Fin Height 58 to Fin Width 50 |
|---|---|---|---|---|
| Aluminum | Laminar | 15 | 1.5 | 10 |
| Aluminum | Turbulent | 4 | 0.4 | 10 |
| Copper | Laminar | 15 | 0.8 | 20 |
| Copper | Turbulent | 4 | 0.2 | 20 |

It is apparent from the tabular results that the fin height 58 is independent of the fin material but the fin base width 50 is dependent on the fin material. It follows that the ratio of the fin height 58 to the fin base width 50 is dependent on the fin material. The lower the thermal conductivity of the fin material the higher is the fin base width 50 for a given working fluid flow rate. Thus since the thermal conductivity of aluminum is about half the thermal conductivity of copper, the fin base width 50 of the aluminum fin is twice the fin base width 50 of the copper fin for a given working fluid flow rate.

The tabular results further show that the higher the working fluid flow rate, the lower the fin height 58 and the fin base width 50. In fact, the determining factor for the fin dimensions, as far as the fluid flow rate is concerned, is the convective heat transfer coefficient, which has higher values at higher (turbulent) flow rates and lower values at lower (laminar) flow rates. The higher the convective heat transfer coefficient the lower is the fin height 58 and the fin base width 50.

It is also apparent from the tabular values in the last column of Table 1 that for an optimally sized fin, the fin height 58 is greater than the fin base width 50. This suggests that for better heat dissipation it is advantageous to use as many relatively taller but smaller base width fins as practical to populate a given heat dissipation area 26. The desired ratio of the fin height 58 to the fin base width 50 is in the range of 10 to 20 depending on the fin material and the working fluid flow rate.

In addition, the fin dimensions are dependent on the thermal conditions imposed on the fin namely the heat dissipation rate and the temperature difference between the fin tip width 54 and the fin base width 50. The fin height 58 is directly proportional to the heat dissipation rate and inversely proportional to the temperature difference between the fin tip width 54 and the fin base width 50. The fin base width 50, on the other hand, is directly proportional to the square of the heat dissipation rate and inversely proportional to the square of the temperature difference between the fin tip width 54 and the fin base width 50.

Although the foregoing tabular values are for a practical fin of interest in the cooling of computer chips corresponding to the stated heat dissipation rate (15 W), fin base-to-tip temperature difference (15° C.) and the fin length 62 (50 millimeters), those of skill in the art can readily scale the values for other conditions without departing from the scope and spirit of the invention and relying on the foregoing scale factors relating to the dependence of the fin dimensions on the fin material, the working fluid flow rate, heat dissipation rate and fin base-to-tip temperature difference.

Best shown in FIG. 1, in addition to the fin height 58 and the fin base width 50, there are other dimensions of the fin including the fin gap 60, the fin length 62, the fin rise 40 and the fin run 42 that may be optimized. The preferred value of the fin gap 60 is in the range of 0.5 millimeter to 2 millimeters. The preferred fin length 62 in the flow direction 36 is at most fifty times the fin gap 60 when the flow is laminar and at most thirty times the fin gap 60 when the flow is turbulent. The preferred value of the fin rise 40 is in the range of 0.5 millimeter to 1 millimeter and the preferred ratio of the fin rise 40 to the fin run 42 is in the range of 1 to 4.

Figure 3:
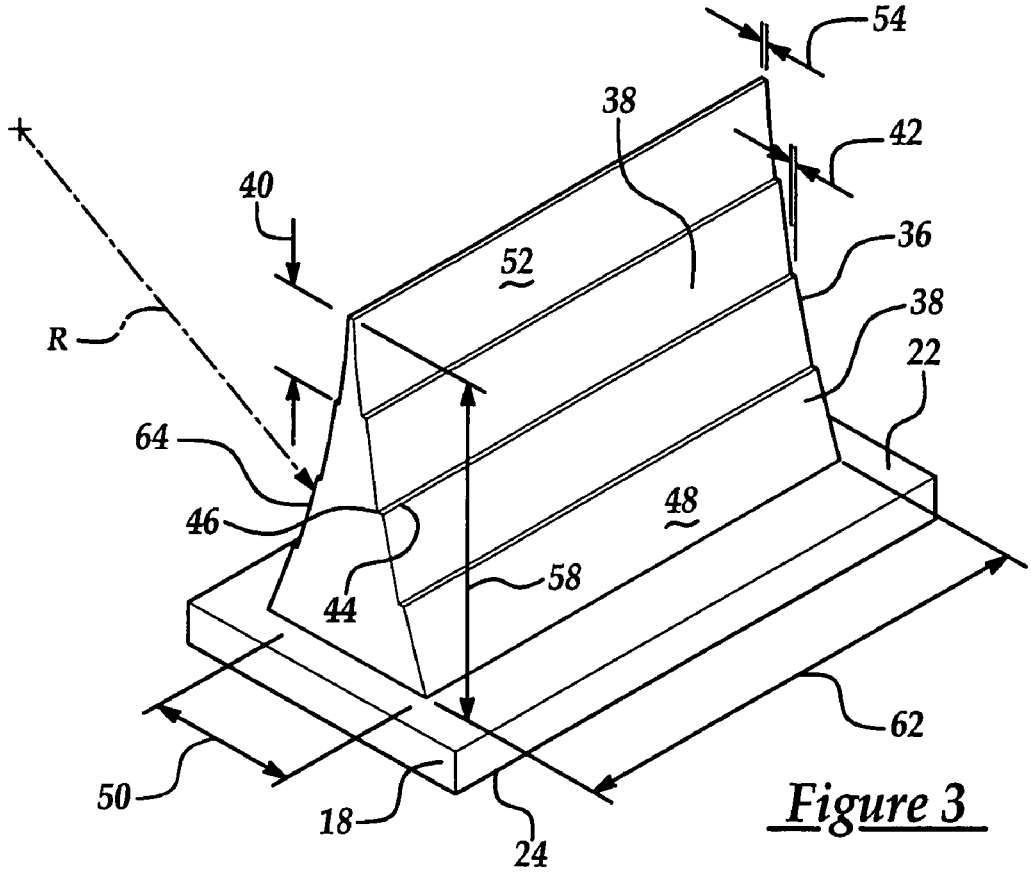
FIG. 3 is an enlarged perspective of an alternative embodiment of one of the plurality of heat transfer fins.

In an alternative embodiment, referring back to FIG. 3, the heat transfer fins 36 have arcuate sides 64 with radius, R. The arcuate sides 64 reduce the mass of the heat transfer fins 36, which improves the heat dissipation while minimizing the fin material cost. Further, the plurality of steps 38 is formed into the arcuate sides 64, which increases the heat dissipation rate. In a preferred embodiment, it is determined that the radius R of the arcuate sides 64 can be determined from the knowledge of the thermal conductivity, k, of the heat transfer fins 36 and the heat transfer coefficient, h, of the working fluid 35 in accordance with the relation $$R = \frac{1}{2}\left(\frac{k}{h}\right)$$

As an example of the arcuate sides 64, if the heat dissipation element 18 is formed of aluminum, then the thermal conductivity, k, is about 209 W/m·K. If the working fluid 35 is a liquid, then the heat transfer coefficient, h, is about 1,200 $W/m^2 \cdot K$ in laminar flow and about 8,000 $W/m^2 \cdot K$ in turbulent flow. Therefore, in accordance with the foregoing relation, the arcuate sides 64 would be formed from a circle having the radius, R, of about 0.5(209/1,200)=0.087 meter=87 millimeters for laminar flow and about 0.5(209/8,000)=0.013 meter=13 millimeters for turbulent flow. These values suggest that in laminar flow, it is most advantageous for the sides 64 to be essentially straight indicated by the large value of the radius R=87 millimeters, whereas in turbulent flow, it is most advantageous for the sides 64 to be the arc of a circle indicated by the relatively smaller value of the radius R=13 millimeters.

Presented in Table 2 are optimal values of the fine height 58 and the fin base width 50 for a boiler plate assembly 28 used in conjunction with a TCU 10. The fin is designed to dissipate 15 W of heat with a temperature difference of 15° C. between the fin tip and the fin base. The fin length 62 is 50 millimeters. The tabular results correspond to two fin materials, aluminum and copper. Unlike the case of a cold plate assembly (Table 1), there is no forced flow of the working fluid 35 through a boiler plate assembly. As such, the working fluid flow rate does not appear as a parameter in Table 2.

TABLE 2

Optimal Fin Height 58 and Fin Base Width 50 for a Boiler Plate Assembly 28 with Fin Tip-to-Base Width Ratio of 0.5

| Fin Material | Fin Height 58, mm | Fin Base Width 50, mm | Ratio of Fin Height 58 to Fin Width 50 |
|---|---|---|---|
| Aluminum | 12 | 3 | 4 |
| Copper | 6 | 1.5 | 4 |

The preferred ratio of the fin height 58 to the fin base width 50 is in the range of 1 to 4. In addition to the fin height 58 and the fin base width 50, there are other critical dimensions of the fin including the fin gap 60, the fin rise 40 and the fin run 42. The preferred value of the fin gap 60 is in the range of 0.5 millimeter to 1.5 millimeter. The preferred value of the fin rise 40 is in the range of 0.2 millimeter to 0.4 millimeter and the preferred ratio of the fin rise 40 to the fin run 42 is in the range of 1 to 2. Unlike the case of a cold plate assembly, there is no preferred value of the fin length 62 since with a boiler plate assembly there is no concern about bridging of the fin gap 60 due to growth of the thermal boundary layers on the opposing walls of the adjoining fins 36 caused by the forced flow of the working fluid 35 through the fin gap 60 as explained above.

On comparing the optimal dimensions of the boiler plate assembly with the corresponding dimensions of the cold plate assembly, it found that they are different. The differences between the two sets of values stem from the fact that the basic heat transfer mechanism in a cold plate assembly is predominantly forced convection whereas that in a boiler plate assembly is nucleate boiling. The heat transfer coefficients involved in the nucleate boiling are generally higher than the convective heat transfer coefficients involved in forced convection.

In the case of an alternative embodiment of the boiler plate assembly 28 of the TCU 10, the heat transfer fins 36 have arcuate sides 64 with radius, R, which can be determined from the knowledge of the thermal conductivity, k, of the heat transfer fins 36 and the heat transfer coefficient, h, of the working fluid 35 in accordance with the relation $$R = \frac{1}{2}\left(\frac{k}{h}\right).$$

As an example of the arcuate sides 64, if the heat dissipation element 18 is formed of aluminum, then the thermal conductivity, k, is about 209 W/m·K. If the working fluid 35 is R-134a capable of changing its state from liquid-to-vapor during boiling over the boiler plate surface, then the heat transfer coefficient, h, during boiling of R-134a is about 10,000 $W/m^2 \cdot K$. Therefore, in accordance with the foregoing relation, the arcuate sides 64 would be formed from a circle having the radius, R, of about 0.5(209/10,000)=0.0105 meter=10 millimeters. This value shows that the radius R of the alternate embodiment fin 36 used in a boiler plate assembly is smaller than the radius R used in a cold plate assembly. This difference is clearly due to higher value of the boiling heat transfer coefficient in the boiler plate assembly compared to the forced convection heat transfer coefficient in the cold plate assembly.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A heat dissipation element for cooling an electronic device, said heat dissipation element comprising:

a bottom surface for mounting thereto an electronic device to be cooled;

a top surface defining a heat dissipation area for dissipating heat from the electronic device; and a plurality of heat transfer fins projecting upwardly from said top surface and being coextensive with said heat dissipation area;

wherein each of said heat transfer fins defining a plurality of steps having a rise and a run and each of said steps extending across said heat dissipation area for maximizing an amount of heat to be dissipated from the electronic device; and wherein said heat transfer fins have arcuate sides, wherein said arcuate sides have a radius, R, defined by the thermal conductivity, k, of said heat transfer fins and the heat transfer coefficient, h, of said working fluid by the relation $$R = \frac{1}{2}\left(\frac{k}{h}\right).$$

2. A heat dissipation element as set forth in claim 1 wherein said plurality of steps define a plurality of corner regions functioning as enhanced heat dissipation sites for dissipating increased heat from said heat transfer fins.

3. A heat dissipation element as set forth in claim 1 wherein said heat dissipation element and said plurality of heat transfer fins are formed from a continuous, homogenous material.

4. A heat dissipation element as set forth in claim 1, further comprising a cold plate, wherein said cold plate and said plurality of heat transfer fins are formed in an extrusion process.

5. A liquid cooled unit for cooling an electronic device, said liquid cooled unit comprising:

an electronic device generating an amount of heat to be dissipated;

at least one heat dissipation element for dissipating heat from said electronic device;

an enclosure to house the heat dissipation element;

a fluid moving device for creating a flow of a working fluid through said enclosure;

a working fluid storage tank in fluid communication with said working fluid moving device for storing said working fluid;

a heat exchanger in fluid communication with said fluid moving device for removing heat from said working fluid;

a fluid moving device for forcing a cooling fluid over the external surface of said heat exchanger to cool said working fluid flowing in the interior of said heat exchanger;

a cold plate including said at least one heat dissipation element in fluid communication with said working fluid moving device, said heat dissipation element comprising;

a top surface defining a heat dissipation area for dissipating heat from the electronic device, a bottom surface for mounting thereto said electronic device to be cooled, a plurality of heat transfer fins projecting upwardly from said top surface and being coextensive with said heat dissipation area, said plurality of heat transfer fins aligned one of normal and parallel to the direction of a flow of said working fluid, and said plurality of heat transfer fins spaced apart from each with a base gap, each of said heat transfer fins defining a plurality of steps having a rise and a run and each of said steps extending across said heat dissipation area for maximizing an amount of heat to be dissipated from said electronic device;

wherein said heat transfer fins have arcuate sides having a radius, R, defined by the thermal conductivity, k, of said heat transfer fins and the heat transfer coefficient, h, of said working fluid by the relation $$R = \frac{1}{2}\left(\frac{k}{h}\right).$$

* * * * *